US005174347A

United States Patent [19]

Knago

[11] Patent Number: 5,174,347

[45] Date of Patent: Dec. 29, 1992

[54] WATER DISPENSING AND ALIGNMENT APPARATUS

[76] Inventor: Clifford L. Knago, 3504 Boyd, Midland, Tex. 79707

[21] Appl. No.: 685,890

[22] Filed: Apr. 16, 1991

[51] Int. Cl.[5] ..... B65B 3/04

[52] U.S. Cl. ..... 141/382; 141/387; 141/389; 222/74; 137/355.20

[58] Field of Search ..... 222/74, 527, 530, 538, 222/539; 141/98, 279, 382, 387, 388, 392, 389; 137/355.20, 355.23, 801; 433/77, 78; 4/192

[56] References Cited

U.S. PATENT DOCUMENTS

| | | | |
|---|---|---|---|
| 2,168,951 | 8/1939 | Caldwell | 137/355.25 |
| 2,257,368 | 9/1941 | Cochin | 137/355.25 |
| 4,114,273 | 9/1978 | McGaha | 433/78 X |
| 4,187,962 | 2/1980 | Henry | 222/74 X |
| 4,195,674 | 4/1980 | Madden | 141/792 |
| 4,391,588 | 7/1983 | Matsui | 433/78 X |
| 5,073,991 | 12/1991 | Marty | 4/192 |

FOREIGN PATENT DOCUMENTS

| | | | |
|---|---|---|---|
| 554752 | 2/1957 | Belgium | 141/389 |
| 1032899 | 7/1953 | France | 4/192 |
| 2223000 | 3/1990 | United Kingdom | 141/388 |

*Primary Examiner*—Ernest G. Cusick
*Attorney, Agent, or Firm*—Leon Gilden

[57] ABSTRACT

An organization for dispensing of water from a water dispensing organization to include a housing with a wall opening directed therethrough, the wall opening includes a flexible hose reciprocatably mounted within the opening and biased in a retracted configuration relative to the housing to direct water from the water reservoir contained within the housing. A wall opening frame member defined by a pliant polymeric material is mounted within the rigid housing to receive a rigid container aligning member resiliently within the frame member. The aligning member includes a mounting plate mounting a "U" shaped handle fixedly to a rear surface of the plate, with the plate mounting an aligning enclosure, wherein the enclosure includes planar side walls and arcuate forward wall for ease of directing the enclosure within the frame member. The aligning enclosure includes a rigid conduit in fluid communication with the flexible hose. The enclosure provides self-centering of the enclosure overlying the container neck to position the rigid conduit in alignment with the container for filling of the container.

6 Claims, 5 Drawing Sheets

WATER DISPENSING AND ALIGNMENT APPARATUS

BACKGROUND OF THE INVENTION

1. Field of the Invention

The field of invention relates to dispensing apparatus, and more particularly pertains to a new and improved water dispensing and alignment apparatus for selective filling of fluid containers.

2. Description of the Prior Art

Various dispensing organizations are utilized in the prior art to effect filling of containers. Such dispensing devices utilize relatively complex and inefficient mechanisms for positioning an outlet conduit overlying various containers of various configurations to effect filling thereof. The instant invention attempts to overcome deficiencies of the prior art by providing a self-centering container mounting a nozzle in a recessed orientation relative to an alignment housing for filling of such containers.

Accordingly the organization of the instant invention provides for a sanitary dispensing apparatus accommodating grasping by individuals and minimizing contamination of dispensed fluid during filling procedures of various containers.

The invention further has completely eliminated need for self-closing doors in a vending apparatus such as utilized in conventional water dispensing vending apparatus. Further, the dispensing spout of the invention provides for an enclosed sanitary environment for the associated dispensing spout during periods of non-use and storage of the dispensing spout within the vending maching housing.

As such, it may be appreciated that there continues to be a need for a new and improved water dispensing and alignment apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of dispensing apparatus now present in the prior art, the present invention provides a water dispensing and alignment apparatus wherein the same provides for sanitary alignment of a water dispensing conduit relative to a container to be filled. As such, the general purpose of the present invention, which will be described subsequently in greater detail, is to provide a new and improved water dispensing and alignment apparatus which has all the advantages of the prior art dispensing apparatus and none of the disadvantages.

To attain this, the present invention provides an organization for dispensing of water from a water dispensing organization to include a housing with a wall opening directed therethrough, the wall opening includes a flexible hose reciprocatably mounted within the opening and biased in a retracted configuration relative to the housing to direct water from the water reservoir contained within the housing. A wall opening frame member defined by a pliant polymeric material is mounted within the rigid housing to receive a rigid container aligning member resiliently within the frame member. The aligning member includes a mounting plate mounting a "U" shaped handle fixedly to a rear surface of the plate, with the plate mounting an aligning enclosure, wherein the enclosure includes planar side walls and arcuate forward wall for ease of directing the enclosure within the frame member. The aligning enclosure includes a rigid conduit in fluid communication with the flexible hose. The enclosure provides self-centering of the enclosure overlying the container neck to position the rigid conduit in alignment with the container for filling of the container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water dispensing and alignment apparatus which has all the advantages of the prior art dispensing apparatus and none of the disadvantages.

It is another object of the present invention to provide a new and improved water dispensing and alignment apparatus which may be easily and efficiently manufactured and marketed.

It is a further object of the present invention to provide a new and improved water dispensing and alignment apparatus which is of a durable and reliable construction.

An even further object of the present invention is to provide a new and improved water dispensing and alignment apparatus which is susceptible of a low cost of manufacture with regard to both materials and labor, and which accordingly is then susceptible of low prices of sale to the consuming public, thereby making such water dispensing and alignment apparatus economically available to the buying public.

Still yet another object of the present invention is to provide a new and improved water dispensing and alignment apparatus which provides in the apparatuses and methods of the prior art some of the advantages thereof, while simultaneously overcoming some of the disadvantages normally associated therewith.

Still another object of the present invention is to provide a new and improved water dispensing and alignment apparatus wherein the same provides for sanitary filling of containers relative to a water dispensing organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is an isometric illustration in an assembled configuration relative to the dispensing housing.

DESCRIPTION OF THE PREFERRED EMBODIMENT

Figure 1:
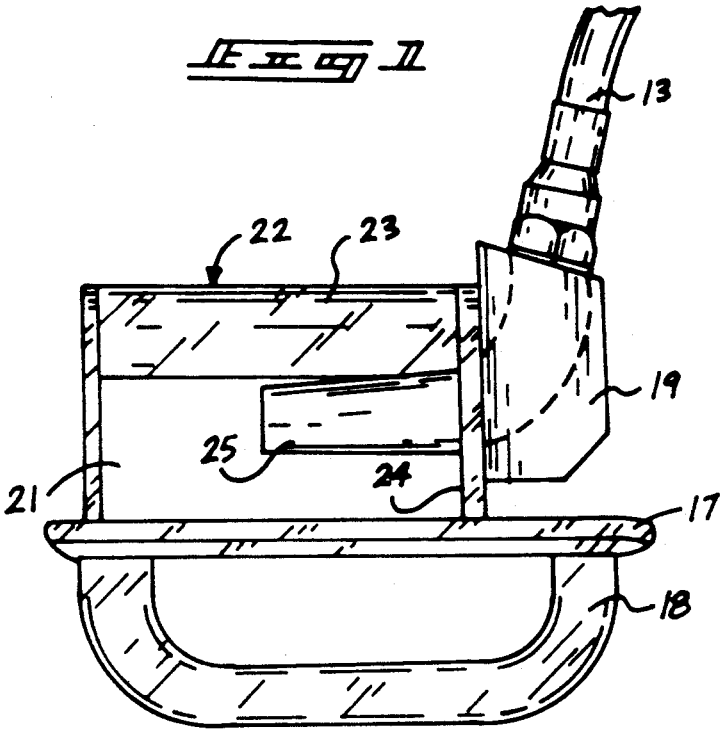
FIG. 1 is an orthographic side view of the container aligning member utilized by the instant invention.
Figure 2:
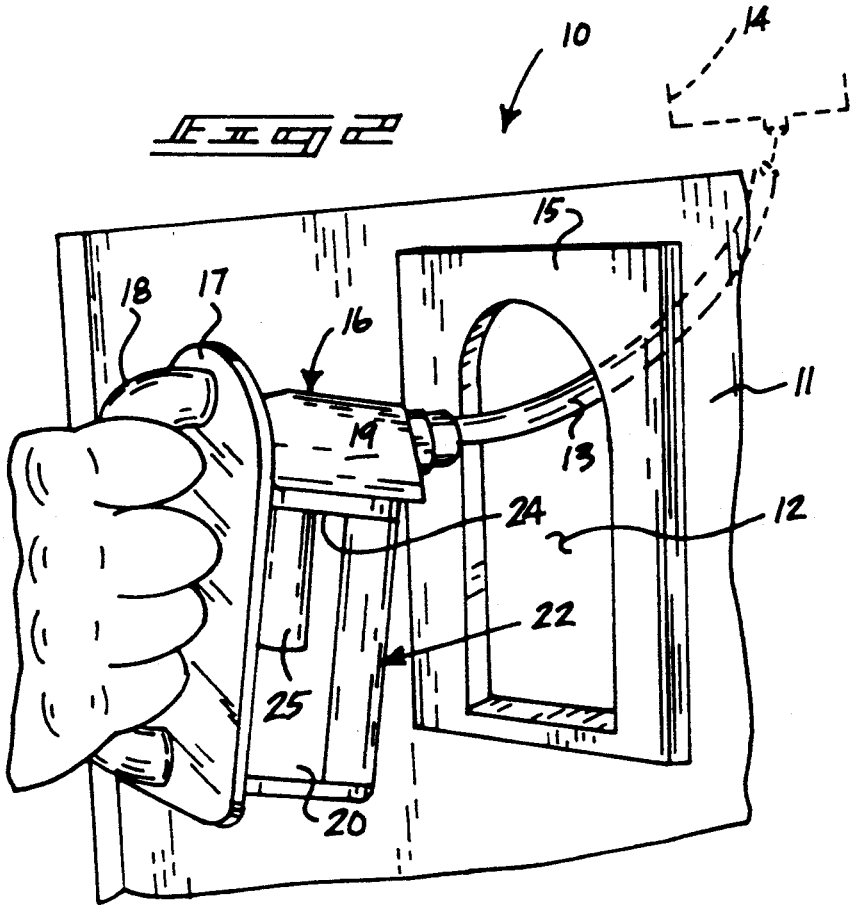
FIG. 2 is an isometric illustration of the instant invention.
Figure 3:
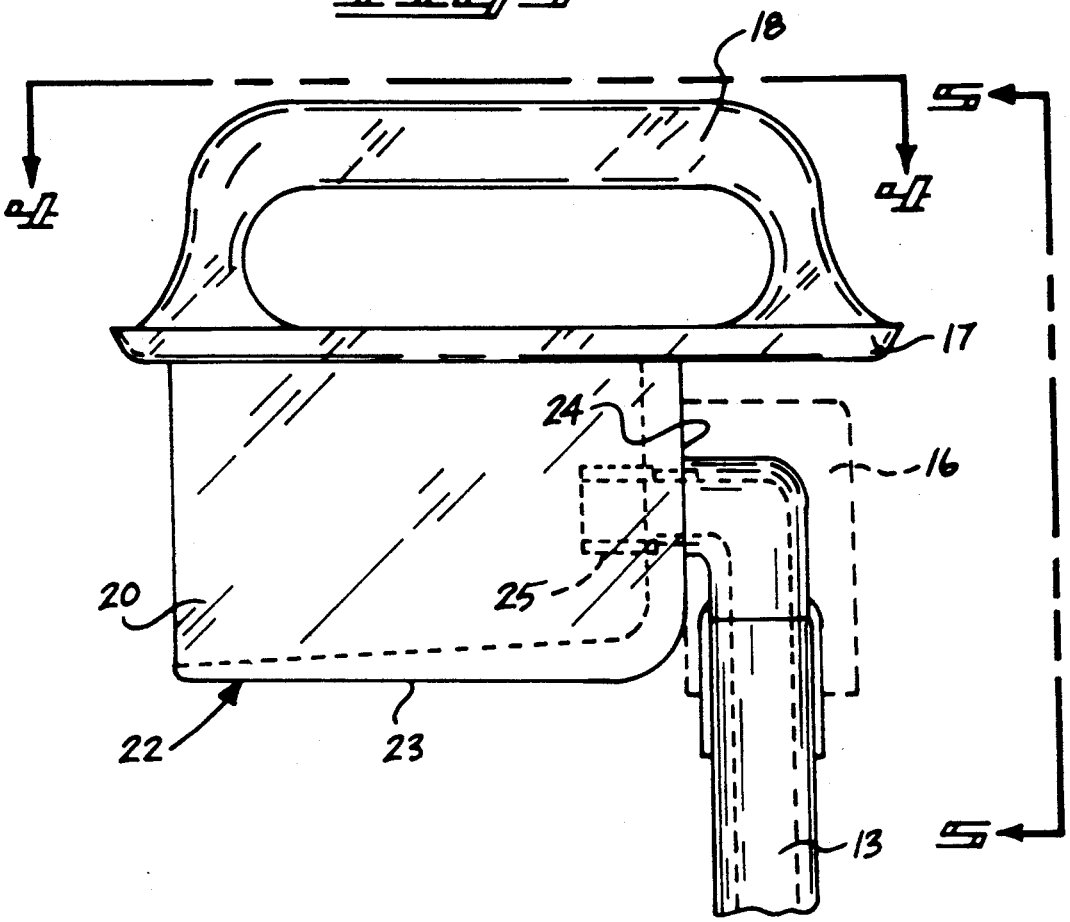
FIG. 3 is an orthographic side view of the container aligning member.
Figure 4:
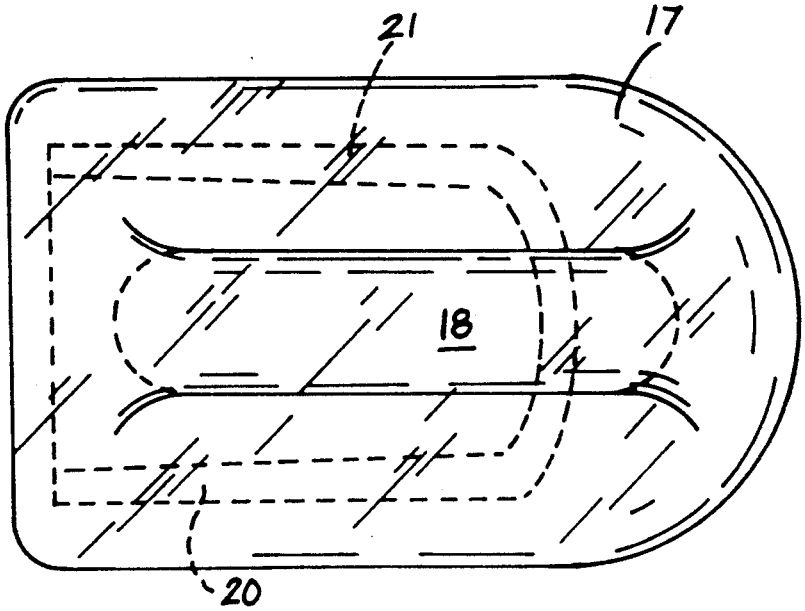
FIG. 4 is an orthographic rear view of the container aligning member.
Figure 5:
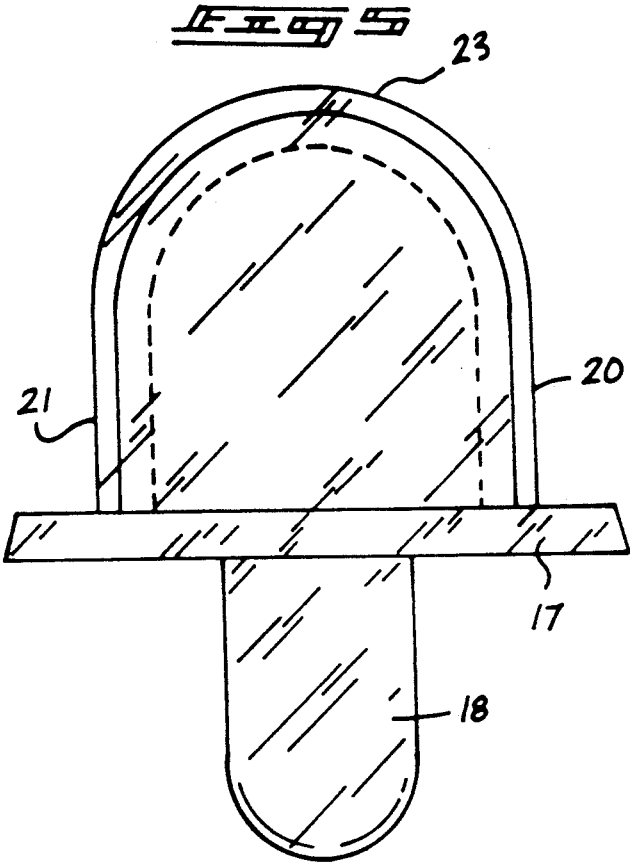
FIG. 5 is an orthographic top view of the container aligning member of the instant invention.
Figure 6:
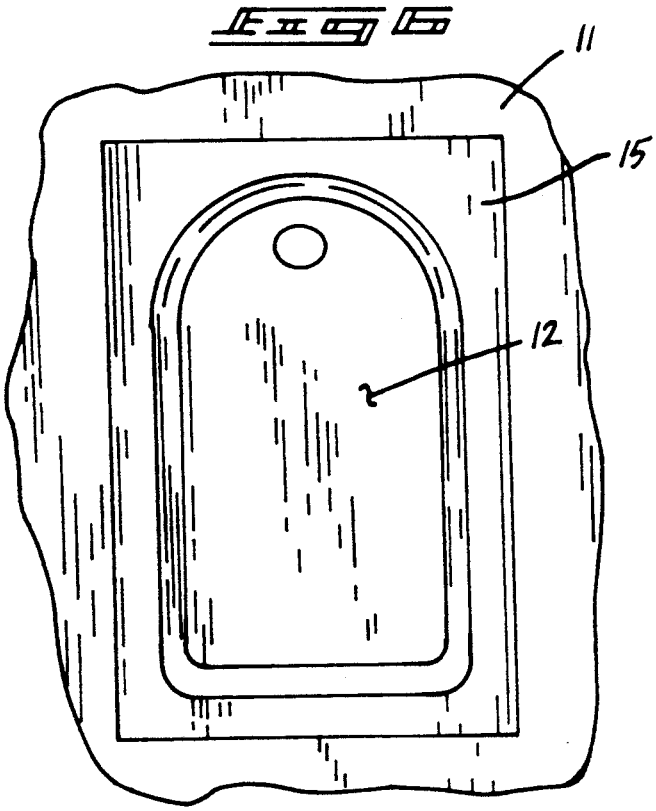
FIG. 6 is an orthographic frontal view of the housing opening and surrounding pliant frame member.
Figure 7:
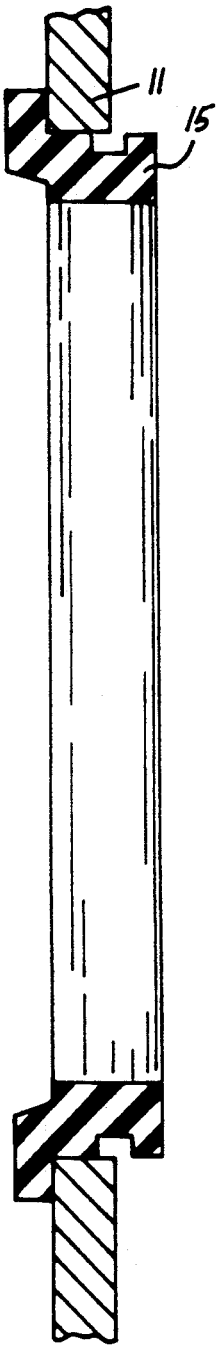
FIG. 7 is an orthographic cross-sectional illustration of the wall opening frame member mounted within the associated forward wall of the housing.

With reference now to the drawings, and in particular to FIGS. 1 to 10 thereof, a new and improved water dispensing and alignment apparatus embodying the principles and concepts of the present invention and generally designated by the reference numeral 10 will be described.

More specifically, the water dispensing and alignment apparatus 10 of the instant invention essentially comprises a water dispensing housing, including a forward vertical wall 11, including a wall opening 12 directed therethrough. The wall opening 12 retractably mounts a flexible hose 13 through the wall opening 12 to direct water from a water reservoir 14 to an associated container "C", in a manner as set forth in FIG. 8 for example. A wall opening frame member 15 defines the wall opening 12 and mounted in alignment with the housing forward wall 11, wherein the frame member 15 is defined by a pliant memory retentent polymeric material to define a wall opening 12 of predetermined configuration. Frictionally received within the wall opening 12 is a rigid container aligning member 16 defining an external configuration substantially equal to the predetermined configuration of the opening 12. The aligning member 16 includes a planar, rigid mounting plate 17 that fixedly and orthogonally mounts a "U" shaped handle 18 to a rear surface of the plate 17. A hose receiving boss 19 is mounted overlying an aligning enclosure 22. It should be noted that the mounting plate 17 extends laterally beyond the hose receiving boss 19 receiving the flexible hose 13 and the associated aligning enclosure 22. The laterally extending plate 17 accordingly effects a sealing relationship with the frame member 15 by a forward surface of the plate 17 and a forward surface of the frame member 15, in a manner as illustrated in FIG. 10 for example.

Figure 8:
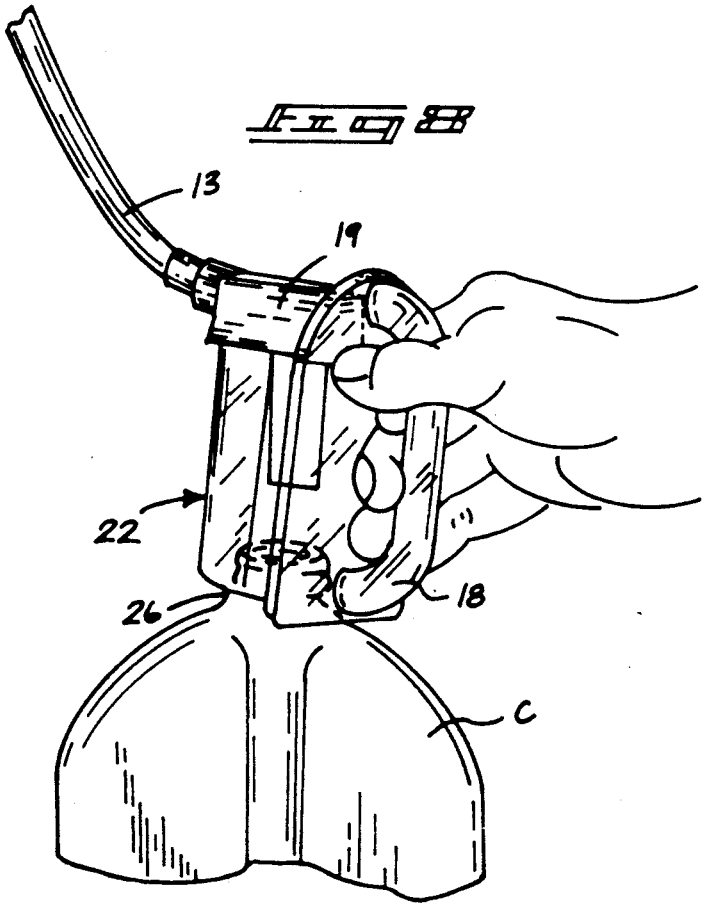
FIG. 8 is an isometric illustration of the container aligning member aligned over an associated container.
Figure 9:
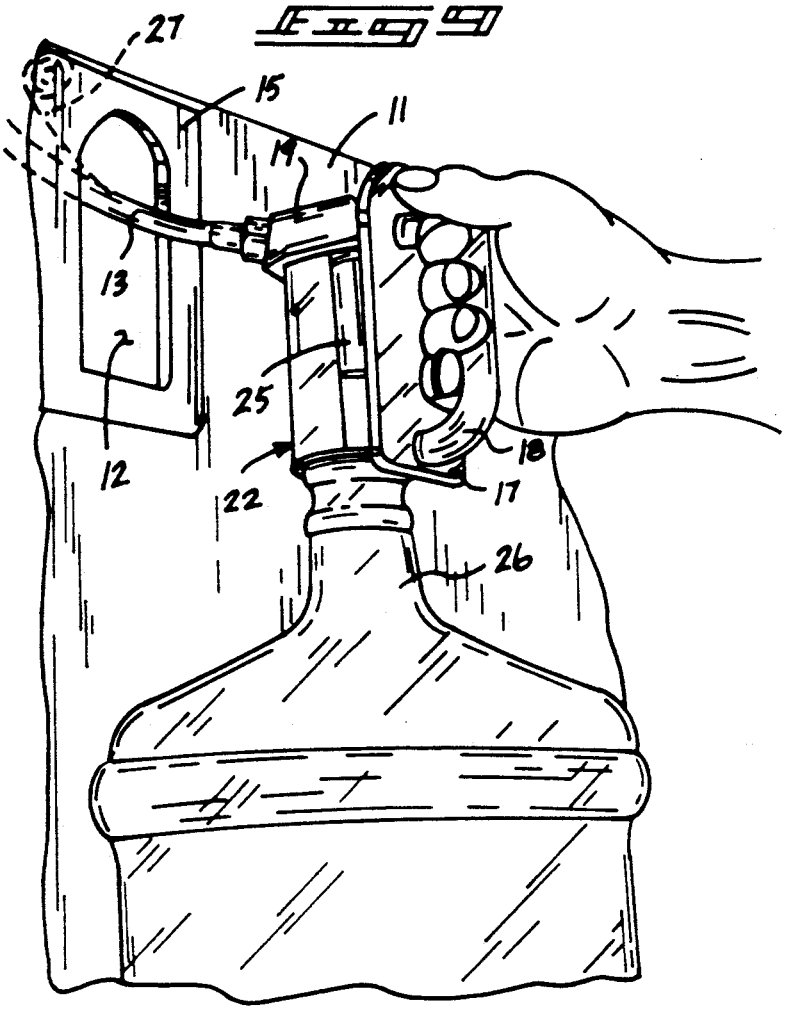
FIG. 9 is an isometric illustration of the instant invention in use.
Figure 11:
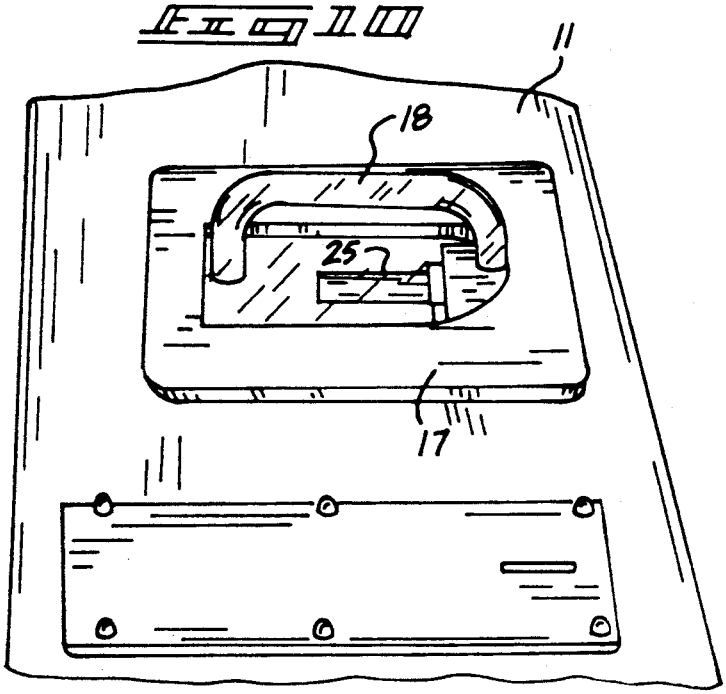

The aligning enclosure 22 includes spaced transparent parallel planar side walls defined by a respective first and second rigid planar side wall 20 and 21 that are orthogonally mounted to the forward surface of the plate 17 and an arcuate forward wall 23 mounted to forward terminal ends of the first and second side walls 20 and 21. An enclosure top wall 24 is mounted overlying the side and forward walls and defines a container receiving opening at lower terminal ends of the forward and side walls to receive a container "C" therewithin. The enclosure top wall 24 mounts the hose receiving boss 19 fixedly thereon, wherein a rigid conduit 25 is mounted orthogonally through the top wall 24 in fluid communication with the flexible hose 13. The rigid conduit 25 is positioned medially between the first and second side walls 20 and 21 and the arcuate forward wall 23 to medially align a lower terminal end of the rigid conduit 25 with a container neck 26 when the enclosure 22 is mounted overlying the container neck 26 in a manner as illustrated in FIGS. 8 and 9 for example. Further, a retraction spring 27 mounted within the housing rearwardly of the forward wall 11 biases the flexible hose 13 within the housing to effect retraction of the hose and sealing of the forward surface of the plate 17 with the forward surface of the frame member 15 subsequent to the directing of fluid from an associated water reservoir 14 within the housing through the conduit 25 into the associated container "C".

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water dispensing and alignment apparatus comprising, in combination, a dispensing housing, the dispensing housing including a forward wall, and the forward wall including a pliant memory retentent polymeric frame member mounted within the forward wall defining an opening, the opening defining a predetermined configuration, and a water reservoir mounted within the housing, and the water reservoir including a flexible hose having an upper terminal end and a lower terminal end in fluid communication with the water reservoir at the upper terminal end of the flexible hose, and a container aligning member, and the lower terminal end of the flexible hose mounted to the container aligning member, and the container aligning member including a rigid mounting plate, the rigid mounting plate including a planar rear surface and a planar forward surface, and the frame member including a planar frame member forward surface, wherein the planar frame member forward surface and the rigid mounting plate forward surface are arranged in contiguous communication relative to one another when the container aligning member is received within the wall opening, and the container aligning member includes an aligning enclosure mounted to the mounting plate forward surface, with a hose receiving boss mounted fixedly overlying the aligning enclosure, and a rigid conduit directed interiorly of the aligning enclosure in fluid communication with the flexible hose through the hose receiving boss, and wherein the hose receiving boss and the aligning enclosure define a predetermined external configuration equal to the predetermined configuration defined by the wall opening.

2. An apparatus as set forth in claim 1 wherein the aligning enclosure includes transparent planar parallel side walls orthogonally mounted to the plate forward surface, the side walls having forward terminal ends and an arcuate forward wall mounted to the forward terminal ends of the side walls to enhance entrance of the aligning enclosure within the wall opening, and the aligning enclosure including a top wall fixedly mounting the hose receiving boss thereon, and the rigid conduit is mounted orthogonally through the top wall and is medially positioned between the side walls and the forward wall, and the rigid conduit is positioned above an enclosure opening defined by an enclosure lower terminal end defined by lower terminal ends of the side and forward walls.

3. An apparatus as set forth in claim 2 wherein the mounting plate extends laterally beyond the aligning enclosure and the hose receiving boss to effect a sealing relationship between the plate forward surface and the frame member forward surface.

4. An apparatus as set forth in claim 3 including a handle mounted to the plate rear surface.

5. An apparatus as set forth in claim 4 including a retraction spring mounted within the housing to bias the flexible hose interiorly of the housing and effect sealing of the plate forward surface and the frame member forward surface.

6. An apparatus as set forth in claim 5 wherein the aligning enclosure, the hose receiving boss, and the mounting plate are formed of a rigid material for enhanced sealing relationship of the container aligning member with the frame member.

* * * * *